US007152351B2

(12) United States Patent
Eby et al.

(10) Patent No.: US 7,152,351 B2
(45) Date of Patent: Dec. 26, 2006

(54) CASCADABLE FILE JACKETS

(75) Inventors: David C. Eby, Madison, WI (US); Gilius A. Gaska, Madison, WI (US); Aaron W. Smith, Madison, WI (US)

(73) Assignee: Rubbermaid Incorporated, Wooster, OH (US)

( * ) Notice: Subject to any disclaimer, the term of this patent is extended or adjusted under 35 U.S.C. 154(b) by 152 days.

(21) Appl. No.: 10/626,082

(22) Filed: Jul. 24, 2003

(65) Prior Publication Data

US 2005/0016037 A1 Jan. 27, 2005

(51) Int. Cl.
*G09F 1/10* (2006.01)

(52) U.S. Cl. ..... 40/124.2; 40/654.01; 40/661; 211/55

(58) Field of Classification Search ..... 40/124.2, 40/530, 537, 654.01, 661, 776; 211/55; 402/79
See application file for complete search history.

(56) References Cited

U.S. PATENT DOCUMENTS

| | | | | |
|---|---|---|---|---|
| 16,829 | A | 3/1857 | French | |
| 399,979 | A | 3/1889 | Dyrenforth | |
| 473,540 | A | 4/1892 | Wheeler | |
| 712,137 | A | 10/1902 | Jackson | |
| 759,946 | A * | 5/1904 | Weber | 248/465 |
| 898,034 | A | 9/1908 | Brunn | |
| 1,021,598 | A | 3/1912 | Harrington | |
| 1,037,607 | A | 9/1912 | Floto | |
| 1,119,925 | A | 12/1914 | Chatham | |
| 1,211,065 | A | 1/1917 | Brady | |
| D55,077 | S | 5/1920 | Page | |
| 1,465,244 | A | 8/1923 | Hager | |
| 1,734,618 | A | 11/1929 | Frazier | |
| 1,890,143 | A | 12/1932 | Bales | |
| 1,999,157 | A | 4/1935 | Rand | |
| 2,087,786 | A | 7/1937 | Straus | |
| D119,165 | S | 2/1940 | Guild | |
| 2,308,654 | A | 1/1943 | Goldstein | |
| 2,351,643 | A | 6/1944 | Straus | |
| D158,444 | S | 5/1950 | Converse | |
| 2,630,122 | A * | 3/1953 | Amberg | 40/537 |
| D179,534 | S | 1/1957 | Bullock et al. | |
| 3,280,820 | A * | 10/1966 | Miller | 40/124.2 |
| 3,515,283 | A | 6/1970 | Poteat | |
| 3,870,223 | A * | 3/1975 | Wyant | 229/72 |
| 3,876,077 | A | 4/1975 | Jones | |
| D243,524 | S | 3/1977 | Intini | |
| 4,085,534 | A * | 4/1978 | Eckstein et al. | 40/124.2 |
| 4,085,535 | A * | 4/1978 | Schweinsberg | 40/124.2 |
| 4,125,243 | A | 11/1978 | Liptak | |
| D250,960 | S | 1/1979 | Bitner et al. | |
| D254,013 | S | 1/1980 | Intini | |
| 4,196,536 | A * | 4/1980 | Westberg | 40/771 |
| 4,226,039 | A * | 10/1980 | Young | 40/373 |
| D258,293 | S | 2/1981 | Macowski | |

(Continued)

*Primary Examiner*—Gary C. Hoge
(74) *Attorney, Agent, or Firm*—Marshall, Gerstein & Borun LLP

(57) ABSTRACT

A cascadable file jacket includes a flexible substrate defined by a first and second surface. The cascadable file jacket further includes a file pocket position adjacent to the first surface, the file pocket constructed from a first ply that is folded to connect to a second ply and form an interior pocket. The first ply is folded to include a first tab adapted to fixedly engage the file pocket to the second surface. The second ply is folded to include a second tab adapted to expandably engage the file pocket to the second surface.

23 Claims, 6 Drawing Sheets

U.S. PATENT DOCUMENTS

D260,907 S 9/1981 Giulie et al.
D261,090 S 10/1981 Kapolas
4,372,067 A * 2/1983 Ruffino ..... 40/360
4,378,102 A 3/1983 Portis, Jr.
4,444,314 A 4/1984 Jacobsson
D275,771 S 10/1984 Evans
4,512,480 A 4/1985 Evenson
4,706,396 A 11/1987 Nomura
4,712,679 A 12/1987 Lowe
4,726,556 A 2/1988 Weir
4,796,847 A 1/1989 Kayner
4,871,066 A 10/1989 LaWall
D306,529 S 3/1990 Goodell
4,974,733 A 12/1990 Evans
D314,566 S 2/1991 Davis et al.
5,022,170 A 6/1991 House
5,025,979 A 6/1991 Dellacroce
D320,045 S 9/1991 Mead
D321,293 S 11/1991 Kucsak
D325,933 S 5/1992 Torgison
5,123,191 A 6/1992 Kim
D328,103 S 7/1992 Ambasz
5,152,405 A 10/1992 Schriner
5,154,299 A 10/1992 Hwang
5,180,191 A 1/1993 Biba
D333,227 S 2/1993 Horvath
5,203,457 A 4/1993 Garcia
D335,505 S 5/1993 Chan
5,215,198 A 6/1993 Sutton
D341,376 S 11/1993 Feer
D341,377 S 11/1993 Ringle
D349,925 S 8/1994 Charron et al.
5,386,964 A 2/1995 Mayo
D358,611 S 5/1995 Dainoff et al.
5,421,665 A * 6/1995 Strassberg ..... 402/79
D360,777 S 8/1995 Glebe
5,464,095 A 11/1995 Lacayo
5,487,617 A 1/1996 Cole et al.
5,503,435 A 4/1996 Kline
D388,464 S 12/1997 Najbart
5,699,631 A 12/1997 Tyson
D389,870 S 1/1998 Hart et al.
5,727,766 A 3/1998 Mayo
D397,360 S 8/1998 Cheris et al.
5,791,620 A 8/1998 Carcich, Jr.
D398,458 S 9/1998 Martell
D399,366 S 10/1998 Stravitz
D401,627 S 11/1998 Markelz et al.
5,857,654 A 1/1999 Berman
D410,452 S 6/1999 Ancona et al.
D410,685 S 6/1999 Thorp et al.
D410,910 S 6/1999 Martell
D413,147 S 8/1999 Ruff et al.
D432,578 S 10/2000 Stravitz
D434,804 S 12/2000 Chang
D439,279 S 3/2001 McColskey et al.
6,227,384 B1 5/2001 Saylor et al.
D443,651 S 6/2001 Chang
6,349,491 B1 * 2/2002 Able ..... 40/124.01
D455,785 S 4/2002 Burns
6,668,883 B1 * 12/2003 Buechele ..... 150/131

* cited by examiner

CASCADABLE FILE JACKETS

TECHNICAL FIELD

The cascadable file jacket disclosed herein relates generally to office organizational systems. In particular, the cascadable file jacket is configured for the storage, display, and organization of paper materials in a hanging or supine position.

BACKGROUND

The desks and workspace of office workers are often cluttered with papers, periodicals, notes, and other assorted office paraphernalia that make organization difficult, if not impossible. Observational data shows that office workers tend to organize their workspace according to two different methodologies, some workers pile paperwork and files around their workspace, while others continuously file and organize the paperwork around their workspace. Each method has distinct advantages and disadvantages, piling provides easy access to the loose paper but limits the amount of workspace available for day-to-day usage. Filing systematically organizes and stores paperwork and, in turn, frees workspace, but requires a time consuming system and dedicated usage to be effective.

Known organizational systems, such as letter boxes or vertical files, typically occupy out-of-the-way portions of the workspace or office that makes visual identification of paperwork difficult and time consuming. Generally, it would be desirable to provide an organizational system that offered visual organization and easy identification of important and useful paperwork while enabling items of various shapes and sizes to be easily stored.

BRIEF DESCRIPTION OF THE DRAWINGS

The figures described herein are intended to be illustrative and not limiting of an exemplary embodiment of a display platform in which.

DETAILED DESCRIPTION

Figure 1:
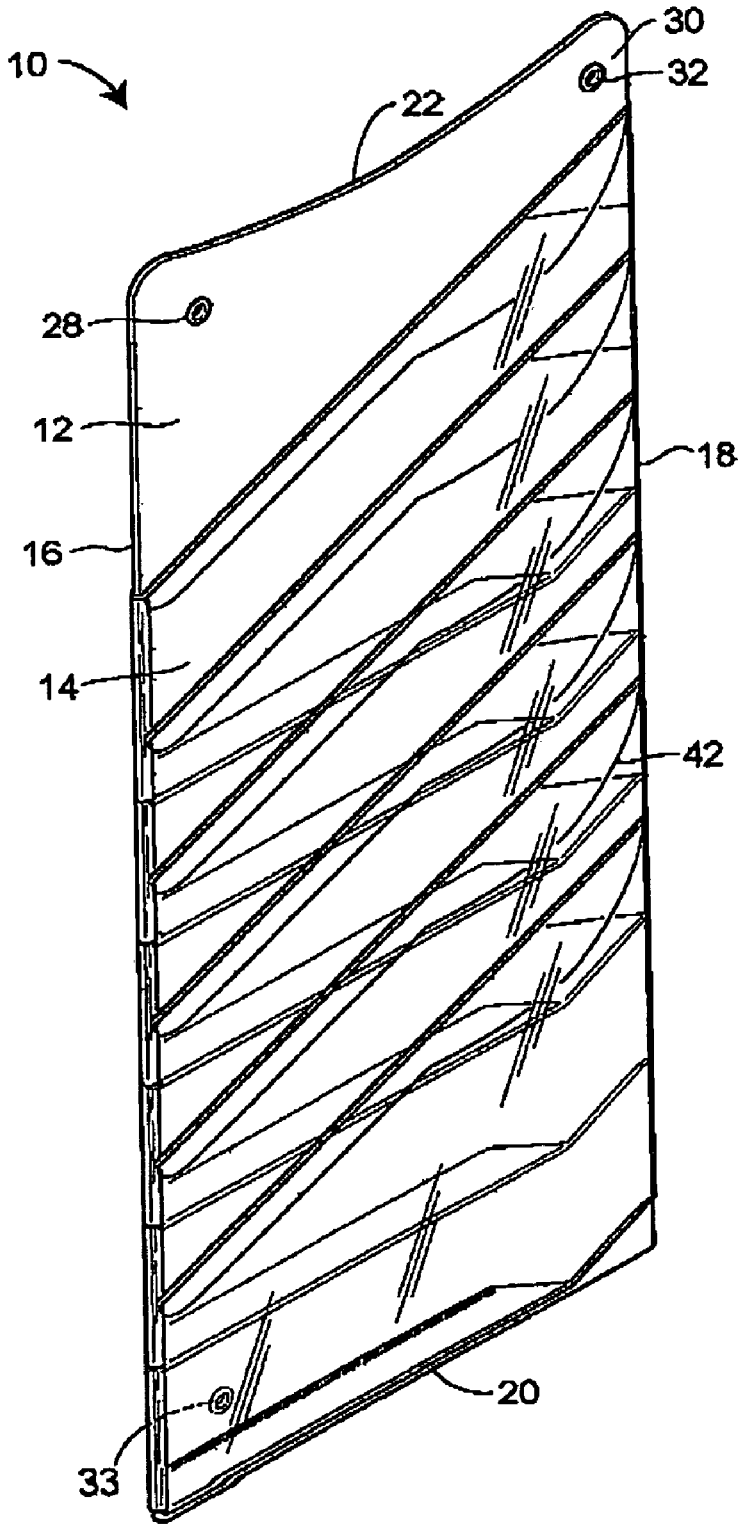
FIG. 1 illustrates an isometric view of an embodiment of a cascadable file jacket system.

FIG. 1 illustrates an exemplary embodiment of a cascadable file jacket system 10 that includes a flexible substrate 12 and a plurality of file jackets 14 configured for use within a workspace active zone. The active zone is generally defined as a portion of the desktop or workspace in which work is actually being conducted, as opposed to space used for storage, or filing of materials.

The cascadable file jacket 10 described herein may be wall mounted, hung from a partition, laid horizontal on a free surface, or inclined against a suitable vertical surface, to provide organization and quick identification of important materials while simultaneously removing desktop clutter and piles. The flexible substrate 12, when used in an inclined orientation, may be configured to include an easel mechanism (not shown) which can be, but is not limited to, a foldable triangular stand or at least one foldable leg fixedly attached to the flexible substrate 12. Further, the cascadable file jacket system 10 is arranged so that the flexible substrate and the plurality of attached file jackets 14 may be moved within the workspace active zone simply by relocating or reorienting the flexible substrate 12.

Figure 2:
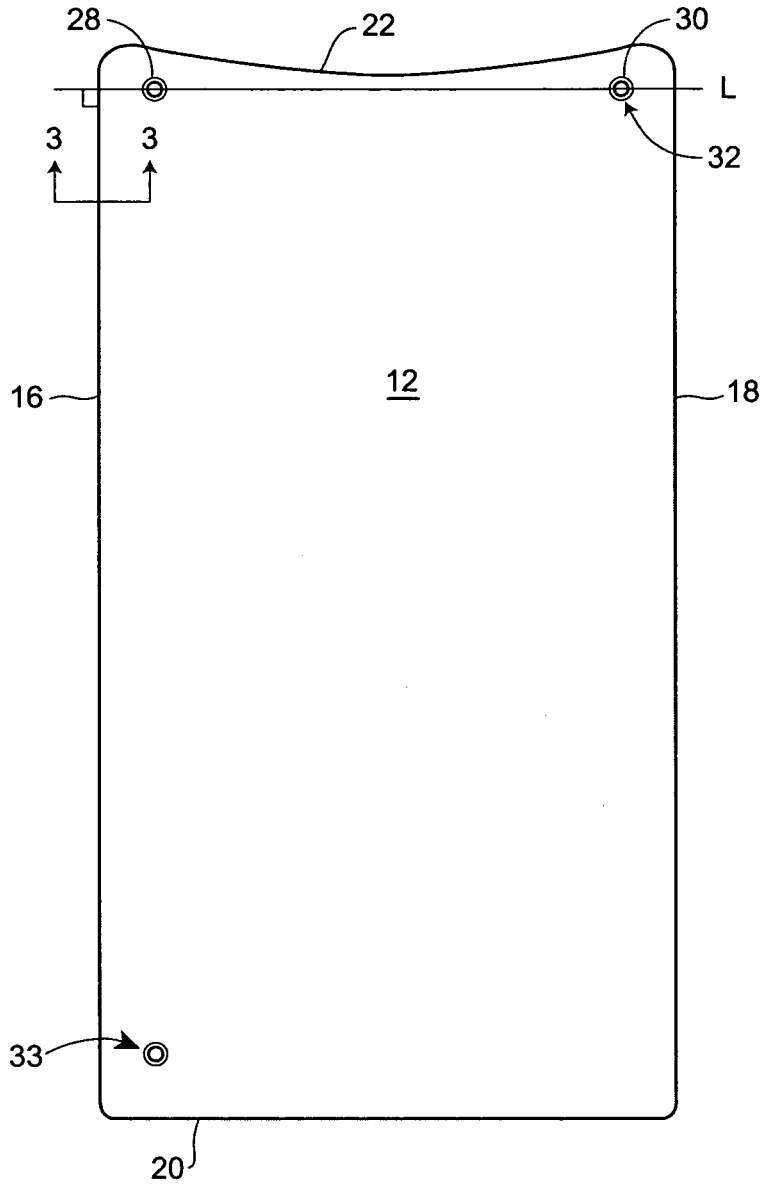
FIG. 2 illustrates a plan view of a flexible substrate shown in FIG. 1.

FIG. 2 further illustrates the flexible substrate 12 as a roughly rectangular shape defined by a first longitudinal edge 16, a second longitudinal edge 18, a first narrow end 20 and a second curvilinear narrow end 22. The flexible substrate 12 may be manufactured from any suitable plastic or color, depending on the application including, but not limited to, translucent or smoke-colored polyethylene (PE) or poly-sheet material.

Figure 3:
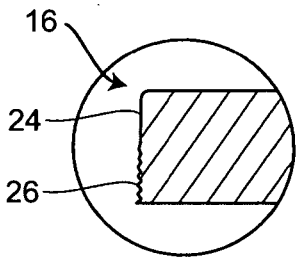
FIG. 3 illustrates an enlarged cross-sectional view of an edge of the flexible substrate of FIG. 2.

The flexible substrate 12 may be manufactured using a variety of processes such as, for example, stamping, punching or rotary die cutting. FIG. 3 illustrates an enlarged view of an edge, as indicated by the section line 3—3, produced by a typical punching or cutting process. The first longitudinal edge 16 typically includes a smooth cut surface 24 and a rough tear-away surface 26. The smooth cut surface 24 may be formed when the sharp working edge of a cutting tool (not shown) pierces the flexible substrate 12, e.g. the polyethylene (PE) material, to a predetermined depth. Upon reaching the predetermined depth, generally two-thirds of the component thickness depending on the component material elasticity, the shear force created by the cutting tool encourages the remaining material to tear and creates the rough surface 26.

Returning to FIG. 2, the flexible substrate 12 further includes first and second mounting holes 28, 30 formed adjacent to the second curvilinear narrow end 22. The curvilinear narrow end 22 may be formed to provide an aesthetic arc and an accessible location for the first and second mounting holes 28, 30. Typically, the first and second mounting holes 28, 30 are aligned along the imaginary line L, and define a right angle with respect to the first and second longitudinal edge 16, 18. The first and second mounting holes 28, 30 are aligned in this way allow the flexible substrate 12 to be vertically suspended by hooks or any other hanging device from available vertical surfaces. The first and second mounting holes 28, 30 may each include a grommet 32, or metal reinforcing ring, affixed to an interior surface (not shown) of the first and second mounting holes 28, 30. The grommet 32 reinforces the flexible substrate 12 and prevents the combined weight of the cascadable file jacket 10 and the stored paperwork from distorting or ripping the first and second mounting holes 28, 30. Additional mounting holes such as the mounting hole 33, may be provided so that the flexible substrate 12 can be hung in different orientations.

Figure 4:
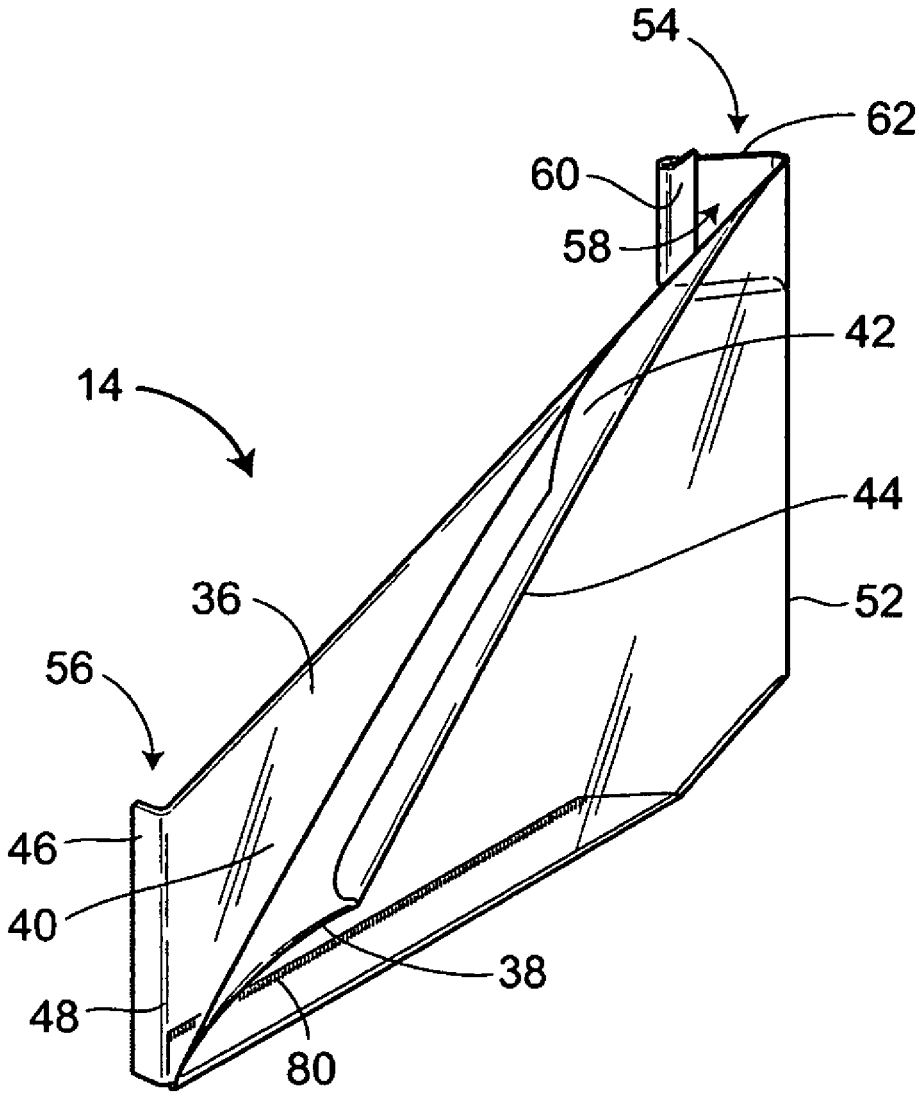
FIG. 4 illustrates an isometric view of a file jacket shown in FIG. 4.

FIG. 4 illustrates a perspective view of the expandable file jacket 14. The file jacket 14 includes a first ply 36 and a moveable second ply 38 arranged to form an interior pocket 40 capable of accepting a numerous sheets of 8.5 in×11 in, 8.4 in×14 in and/or A4-size paper. It will be understood that the interior pocket can be sized to accept a single size of paper, or can be sized to accept multiple sizes depending on the needs of the user and/or the desired versatility of the file jacket system 10. The second ply 38 may further include a label flap 42 folded along a foldline 44 and adapted to accept and protect a label 36, see FIG. 5. The label 34 may be affixed to the interior surface of the label flap 42 such that it is visible through and protected by the second ply 38. The label flap 42 and label 34 cooperate to facilitate visual identification of the contents stored in the interior pocket 40.

The first ply 36 is formed to include an attachment tab 46 folded along a foldline 48 and adapted to engage a back surface 50, adjacent to the first longitudinal edge 16 (see FIGS. 2 and 4), of the flexible substrate 12. The first ply 36 is foldably connected to the second ply 38 along the foldline 52. It should be noted that the foldline 52, or any other foldline identified herein, may be scored to facilitate folding of the different plies or tabs. The second ply 38 further includes an expanding attachment tab 54 formed along a foldline 52 and adapted to engage the back surface 50 of the flexible substrate 12 adjacent to the second longitudinal edge 18, see FIGS. 7 and 8. The expanding attachment tab 54 further includes a bonding portion 60 distal to the foldline 52, and a flexible portion 62. The flexible substrate 12 may be aligned within a first and second crease 56, 58 defined by the cooperation of the first ply 36 and attachment tab 46, and the first ply 36 and the expanding attachment tab 54, respectively.

Figure 5:
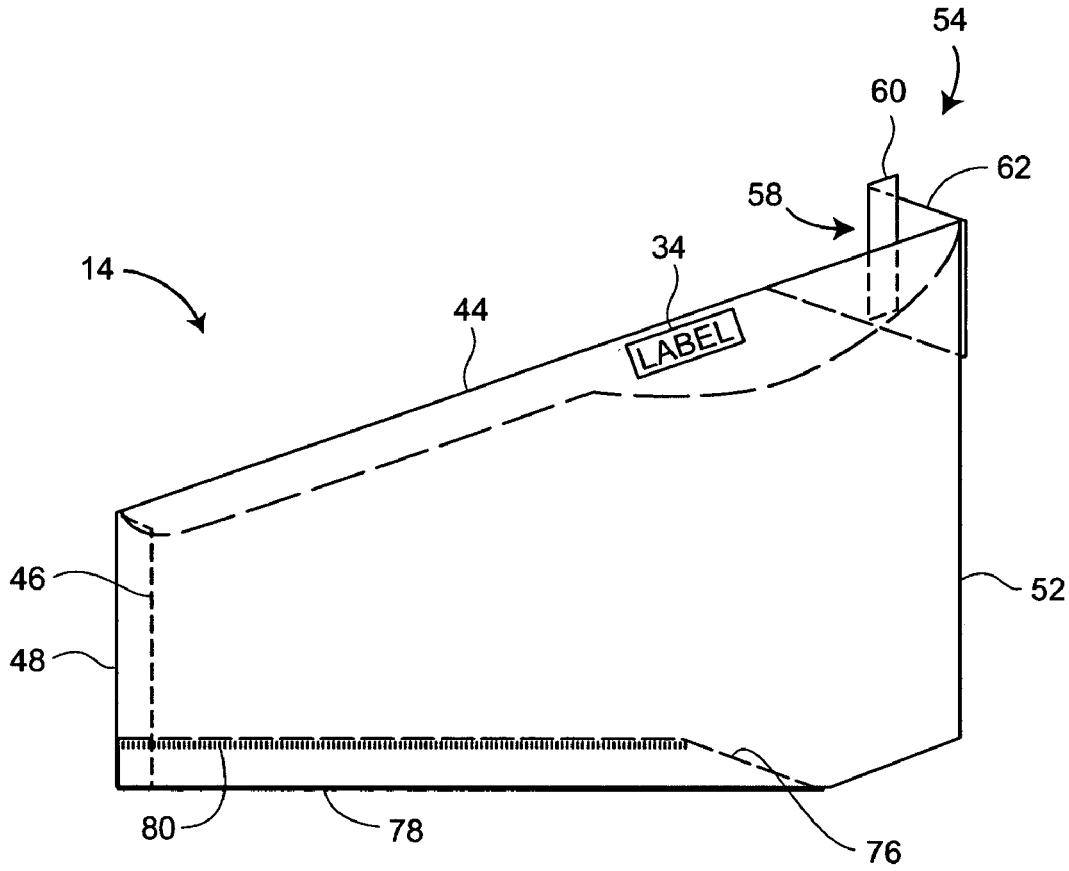
FIG. 5 illustrates a plan view of a file jacket shown in FIG. 1.

FIG. 5 illustrates a plan view of the folded file jacket 14. The file jacket 14 is shown having a roughly triangular shaped second ply 38 defined by the cooperation of the perimeter foldlines 44, 48, 52 and 78. The label 34 can be seen positioned between the label flap 42 and the second ply 38 so that it is visible through the translucent material of the file jacket 14. Further, the attachment tab 54 is arranged to form the second crease 58 prior to affixing the bonding portion 60 to the back side 50 of the flexible substrate 12.

Figure 6:
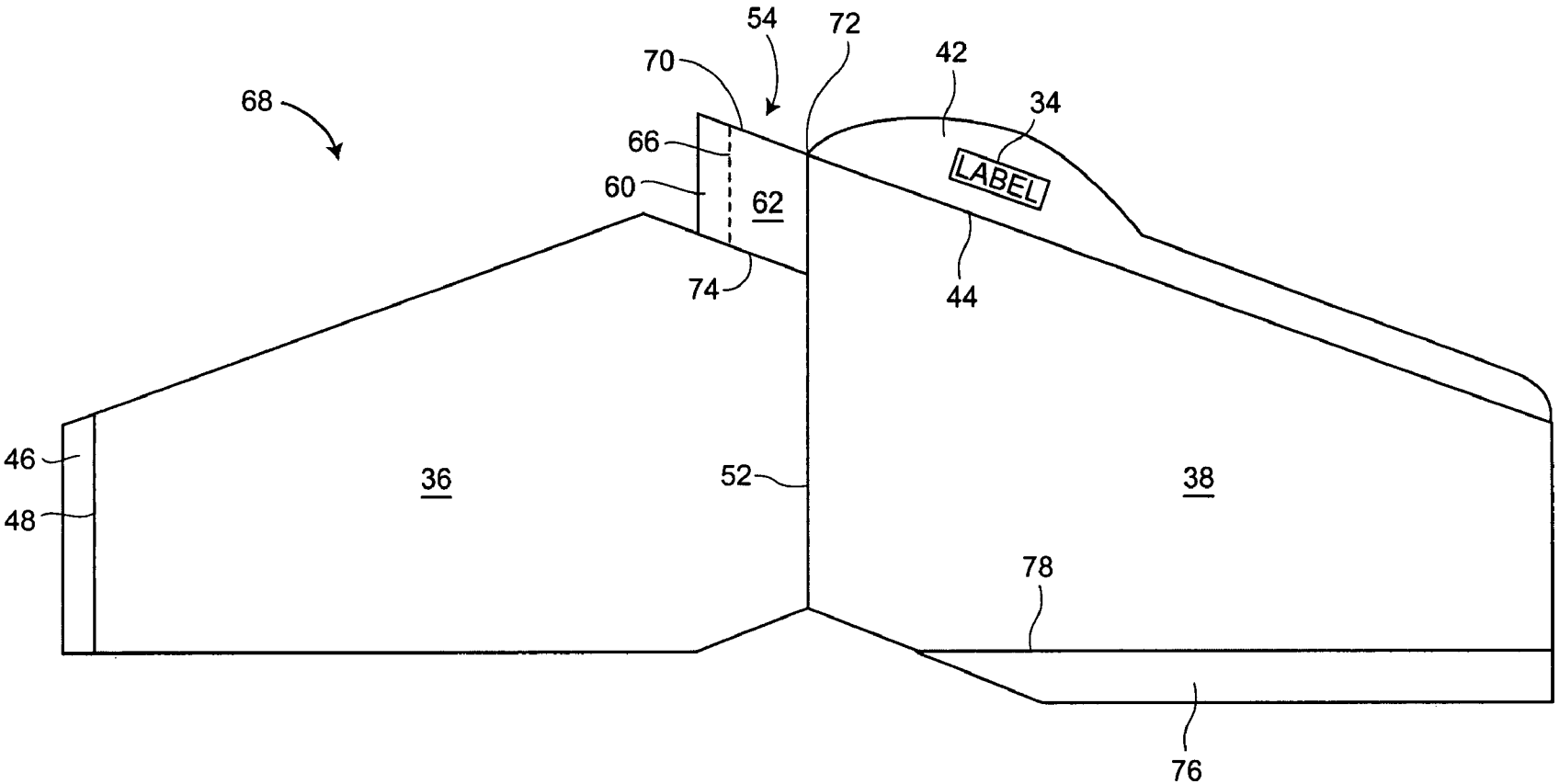
FIG. 6 illustrates a plan view of a file jacket blank.

FIG. 6 illustrates the file jacket 14 as an unfolded blank 68 or poly-sheet prior to folding and assembly. The first ply 36 and the second ply 38 each roughly form a right triangular shape, mirrored about the foldline 52. The first ply 36 and the expanding attachment tab 54 are bendable relative to the second ply 38 along the foldline 52. The attachment tab 54 includes an angled edge 70 that is collinear to the foldline 44 along the angled side of the triangular shaped second ply 38. This collinear arrangement provides for the second ply 36, the label flap 42 and expandable attachment tab 54 to share a common apex, identified by the numeral 72. The attachment tab 54 is separated from the first ply 36 along a cutaway line 74, which allows the attachment tab 54 to move independent of the first ply 36. The second ply further includes a closure tab 76 foldable along the foldline 78.

In order to construct the file jacket 14, as illustrated in FIG. 4, it may be helpful depending on the type, thickness and/or elasticity of the blank 68 material, to score, cut or pre-fold the foldlines 44, 48, 52, 66 and 78. Initially, the label flap 42 is folded along the foldline 44 to rest adjacent to the second ply 38. The blank 68, in turn, is folded along the foldline 52 such that the first ply 36 and the second ply 38 are aligned with, and adjacent to, with each other. The closure tab 76 is folded along the foldline 78 to engage the first ply 36. Finally, the closure tab 76 may be affixed to the first ply 36 using, for example, a heat staking process to close and seal the interior pocket 40 and create the file jacket 14.

Heat staking is a versatile assembly process that requires a short cycle time, can simultaneously form multiple bonds, and does not require consumable material such as rivets or staples. In the above-described example, the closure tab 76 and the first ply 36 are positioned between a heated stud (not shown) and a complimentary hole (not shown) to form a heat staked head 80, shown in FIGS. 4 and 5. The heat staked head 80 is formed when the heated stud conductively engages the first ply 36 and the closure tab 76 to increase the material temperature to near its melting point. The heated stud cooperates with the complimentary hole to deform the malleable materials of the first ply 36 and the closure tab 76 and form a mechanical lock between the two poly-sheets. Heat staking may be used to join dissimilar plastics, such as the file jacket 14 and the flexible substrate 12, or plastics to other materials (e.g. metals). Another benefit associated with the heat staking process is the ability to disassemble the locked components by reapplying heat to the heat staked head 80 to release the mechanical lock. It will be understood that other methods of bonding or attachment of the various layers and plies are also possible, including but not limited to, ultrasonic welding, adhesives, rivets or other fasteners, stitching etc.

Figure 7:
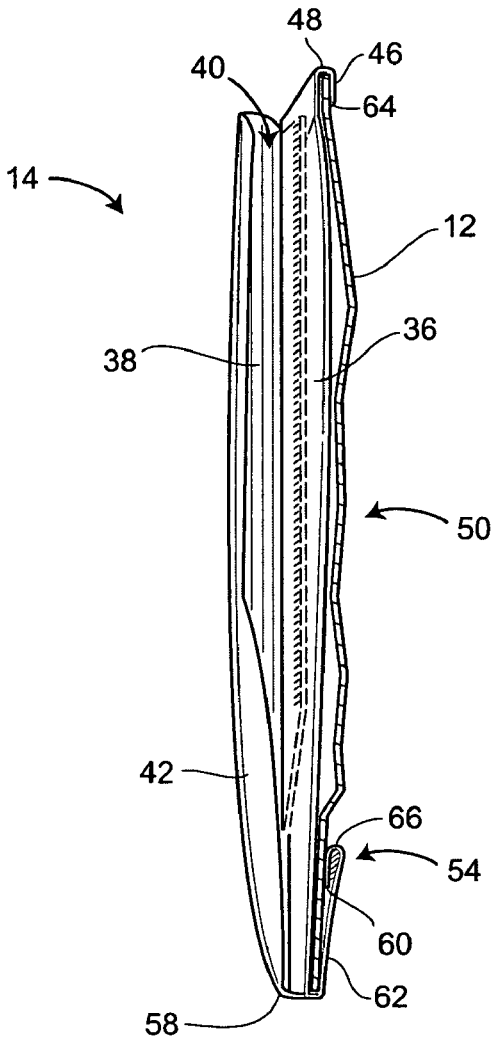
FIG. 7 illustrates a top perspective view of the file jacket of FIG. 4 in a closed position.

FIG. 7 illustrates the file jacket 14 in an unexpanded configuration and arranged to engage the flexible substrate 12. The flexible substrate 12 is positioned within the first and second crease 56, 58 of the file jacket 14 and fixedly attached to the back surface 50 along the bonding portion 60 and a bonding edge 64. The bonding portion 60 and the bonding edge 66 may then be heat staked to the back surface 50, thereby attaching the file jacket 14 to the flexible substrate 12.

In use, the bonding portion 60 of the expanding attachment surface 54 is folded along the foldline 66 in the direction of the second longitudinal edge 18 and the second crease 58. When assembled, the file jacket 14 is affixed to the back surface 50 of the flexible substrate 12 along two points, i.e. the bonding edge 64 and the bonding portion 66, thereby allowing the first ply 36 and the second ply 38 float relative to the front surface of the flexible substrate 12. By arranging the file jacket 14 to float relative to the flexible substrate 12 the storage capacity of the interior pocket 40 can by increased by allowing the first ply 36 to deform relative to the second ply 38. Further, because the first ply 36 does not directly attach to the flexible substrate 12, the user may position material between the for additional storage and/or decoration.

Figure 8:
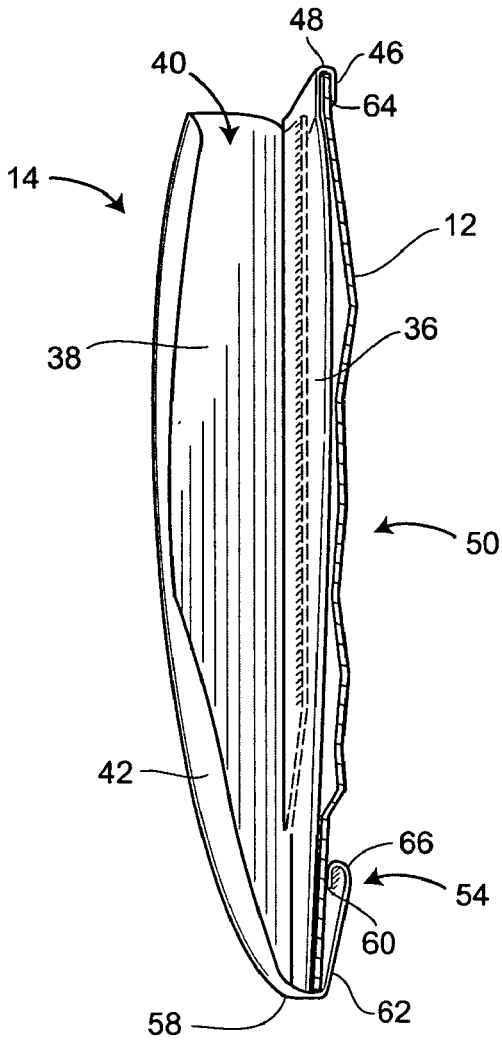
FIG. 8 illustrates a top perspective view of the file jacket of FIG. 4 in an open position.

FIG. 8 illustrates the file jacket 14 in an expanded configuration. The file jacket 14 is expanded when the second ply 38 is pulled away from the first ply 36, relative to the unexpanded configuration shown in FIG. 7. By moving the second ply 38 away from the first ply 36, the flexible portion 62 of the expanding attachment tab 54 is stretched taunt along the second crease 58. As the attachment tab 54 is stretched, the infolded bonding portion 60 is straightened and stretched to provide additional storage space in the interior pocket 40.

While the cascadable file jacket 10 has been described with reference to specific examples, these examples are intended to be illustrative only and not limiting in any way. It will be apparent to those of ordinary skill in the art that changes, modification or deletions may be made to the disclosed embodiments without departing from the spirit and scope of the disclosed device.

We claim:

1. A method of manufacturing a cascadable file jacket comprising:

providing a planar flexible substrate, the flexible substrate having a rectangular shape including a narrow end;

forming a plurality of mounting holes in the narrow end;

attaching an expandable file pocket to the flexible substrate, the pocket having first and second plies cooperating to define an interior, the first ply including an integrally formed first tab and the second ply including an integrally formed second tab, the first and second tabs being adapted to fixedly engage a back surface of the flexible substrate, and a front surface of the flexible substrate being disposed between the back surface and the first ply, and the first ply being disposed between the front surface and the second ply; and attaching additional expandable file pockets to the flexible substrate in a cascading fashion, wherein the first ply remains substantially parallel to the flexible substrate.

2. A method of manufacturing a cascadable file jacket comprising:

providing a flexible substrate, the flexible substrate having a rectangular shape including a narrow end;

forming a plurality of mounting holes in the narrow end; and attaching an expandable file pocket to the flexible substrate, the pocket having first and second plies cooperating to define an interior, the first ply including an integrally formed first tab and the second ply including an integrally formed second tab, the first and second tabs being adapted to fixedly engage a back surface of the flexible substrate, the manufacturing of the expandable file pocket including providing a blank including the first and second plies separated by a foldline, folding the first and second plies along the foldline to define the interior, and affixing the first ply to the second ply to define a two-sided pocket.

wherein a front surface of the flexible substrate is disposed between the back surface of the flexible substrate and the first ply, the first ply is disposed between the front surface of the flexible substrate and the second ply, and the first ply remains substantially parallel to the flexible substrate.

3. A cascadable file jacket comprising:

a flexible substrate having first and second surfaces;

a file pocket adjacent to the first surface, the file pocket including a first ply foldably connected to a second ply, the first surface being disposed between the second surface and the first ply, and the first ply being disposed between the first surface and the second ply;

a first tab formed integrally to the first ply and adapted to fixedly engage the file pocket to the second surface; and a second tab formed integrally to the second ply and adapted to expandably engage the file pocket to the second surface, wherein the first ply remains substantially parallel to the flexible substrate.

4. The cascadable file jacket of claim 3, wherein the flexible substrate includes first and second mounting holes adapted for mounting the flexible substrate in a vertical orientation.

5. The cascadable file jacket of claim 4, wherein the first and second mounting holes each include an annular grommet.

6. The cascadable file jacket of claim 3, wherein the flexible substrate includes a third mounting hole cooperating with the first mounting hole and adapted for mounting the flexible substrate in a horizontal orientation.

7. The cascadable file jacket of claim 3, wherein the file pocket is adapted to accept at least one piece of 8.5 by 11.0 inch paper.

8. The cascadable file jacket of claim 3, wherein the flexible substrate is manufactured from a polypropylene material.

9. The cascadable file jacket of claim 3, wherein the file pocket is manufactured from a translucent poly-sheet material.

10. The cascadable file jacket of claim 3, wherein the first and second tabs are fixedly engaged to the second surface via a heat staking process.

11. The cascadable file jacket of claim 3, wherein the second ply is folded to include a label portion.

12. A cascadable filing system comprising:

a rectangular substrate formed to include a narrow end and first and second mounting holes, the rectangular substrate adapted for mounting in a vertical orientation via the first and second mounting holes; and at least one poly-sheet folded to define a first ply and a second ply, the first ply folded to include an integrally formed first tab and the second ply folded to include integrally formed second and third tabs, the first and second tabs being adapted to engage a back surface of the rectangular substrate, the third tab being adapted to engage the first ply and thereby form a pocket, a front surface of the rectangular substrate being disposed between the back surface and the first ply, and the first ply being disposed between the front surface and the second ply, wherein the first ply remains substantially parallel to the flexible substrate.

13. The cascadable filing system of claim 12, wherein the rectangular substrate further includes a third mounting hole positioned distal to and in-line with the first mounting hole, the first and third mounting holes adapted for mounting the rectangular substrate in a horizontal orientation.

14. The cascadable filing system of claim 12, wherein the second tab further includes an expandable portion, and an attachment surface adapted to be heat staked to the back surface.

15. The cascadable filing system of claim 12, wherein the second ply is further folded to include a label portion.

16. The cascadable filing system of claim 12, wherein the first and second mounting holes include a reinforcing annular grommet fixedly attached to an interior surface.

17. The cascadable filing system of claim 12, wherein the rectangular substrate is manufactured from a polypropylene material.

18. A method of manufacturing a cascadable file jacket comprising:

providing a planar flexible substrate, the flexible substrate having a rectangular shape including a narrow end;

forming a plurality of mounting holes in the narrow end; and attaching an expandable file pocket to the flexible substrate, the pocket having first and second plies cooperating to define an interior, the first ply including an integrally formed first tab and the second ply including an integrally formed second tab, the first and second tabs being adapted to fixedly engage a back surface of the flexible substrate, a front surface of the flexible substrate being disposed between the back surface and the first ply, and the first ply being disposed between the front surface and the second ply, wherein the first ply remains substantially parallel to the flexible substrate.

19. The method of claim 18, further including affixing an annular grommet support ring within an interior of the plurality of mounting holes.

20. The method of claim 18, further including forming a horizontal mounting hole adjacent to a second narrow end, the horizontal mounting hole adapted to cooperate with one of the plurality of mounting holes in the narrow end.

21. The method of claim 18, further including forming a label surface contiguous to the first ply and adjacent to a file pocket opening.

22. The method of claim 18, further including forming a third tab contiguous to the second ply and adapted to fixedly engage the first ply to define a file pocket interior.

23. The method of claim 18, further including providing an expanding portion and an attachment portion integral to the second tab, the attachment portion adapted to be heat staked to the back surface of the flexible substrate.

* * * * *